US006315121B1

(12) United States Patent
Hansen

(10) Patent No.: US 6,315,121 B1
(45) Date of Patent: Nov. 13, 2001

(54) WRENCH RACK

(75) Inventor: Donald Hansen, 3310 Memorial Dr., Two Rivers, WI (US) 54241

(73) Assignee: Donald Hansen, Two Rivers, WI (US)

( * ) Notice: Subject to any disclaimer, the term of this patent is extended or adjusted under 35 U.S.C. 154(b) by 0 days.

(21) Appl. No.: 09/679,958

(22) Filed: Oct. 5, 2000

(51) Int. Cl.[7] ..... B65D 85/28
(52) U.S. Cl. ..... 206/376; 206/451; 211/70.6
(58) Field of Search ..... 206/376, 372, 206/373, 375, 481, 483, 489; 211/70.6; 294/159, 161, 166

(56) References Cited

U.S. PATENT DOCUMENTS

D. 312,017 * 11/1990 Gould ..... D3/74
D. 364,526 * 11/1995 Laufenberg ..... D6/553
D. 392,489 * 3/1998 Ernst ..... D6/571
D. 433,613 * 11/2000 Jialin ..... D3/315
4,911,297 3/1990 Suburu .
5,346,063 9/1994 Chow .
5,505,316 * 4/1996 Lee ..... 211/70.6
5,535,881 * 7/1996 Krivec ..... 206/376
5,598,924 * 2/1997 McCann ..... 206/372
5,638,964 6/1997 Ernst .
6,202,864 * 3/2001 Ernst et al. ..... 211/70.6

* cited by examiner

*Primary Examiner*—Shian Luong
(74) *Attorney, Agent, or Firm*—Andrus, Sceales, Starke & Sawall, LLP

(57) ABSTRACT

A wrench rack has a pair of arms extending from opposite side edges of a planar web. The arms are provided with pairs of aligned slots for receiving a set of wrenches. Each of the slots is formed with a rounded nose having a laterally extended tab provided with indicia for indicating the size of a wrench inserted in the aligned slots. Each nose is formed with an elongated, resilient finger which projects into an upper portion of the slot and provides a continuous biasing force on a top surface of a wrench as it is inserted into the slots.

4 Claims, 1 Drawing Sheet

WRENCH RACK

FIELD OF THE INVENTION

The present invention relates broadly to a tool holder for holding a plurality of tools in an orderly fashion and, more particularly, pertains to a wrench rack for resistively retaining a series of variously-sized wrenches in a parallel, horizontally-oriented formation, such that the wrenches are easily identifiable and accessible.

BACKGROUND OF THE INVENTION

As is well known, wrench racks are utilized to organize and store differently-sized wrenches which heretofore have been haphazardly strewn about a worker's tool box or a support surface adjacent a work site.

One type of wrench holder is disclosed in U.S. Pat. No. 4,911,297 issued Mar. 27, 1990, to Suburu. In this patent, the holder comprises a base tray with an upstanding holding member having multiple slots and a restraining bar mounted at a first angle to the base tray and at a second angle to the holding member. A wrench held in this holder must be rotated through a substantial portion of a 90 degree arc before the wrench handle is no longer engaged in the slot, the wrench shank is no longer constrained between the upstanding member and the restraining bar, and the open end of the wrench pins are pointed substantially to the base tray to allow disengagement of the wrench jaw from the restraining bar.

Another type of wrench rack is shown in U.S. Pat. No. 5,346,063 issued Sep. 13, 1994, to Chow. In this patent, a tool holder includes a pair of walls extended forwardly from a board, and a number of pairs of notches are formed in the walls for accommodating the tools. Each of the notches includes two ends, in which a shoulder is formed on one end and the other end is located closer to the board. A number of resilient members are projected forward of the board and each is aligned with one pair of notches. The resilient members project inwards of the notches for bias in the tools against the shoulders such that the tools can be stably held in place.

A further wrench rack is depicted in U.S. Pat. No. 5,638,964 issued Jun. 17, 1997, to Ernst. In this patent, a wrench rack has arm structures including means biasing the wrenches into contact with an adjacent arm structure to ensure wrench retention. The rack includes a base having oppositely disposed rows of arm structures with a pair of corresponding arm structures serving to grip a wrench thereon to prevent accidental dislodgment. The arm structures include yieldable members which flex to accommodate an inserted wrench handle. A barrier additionally serves to inhibit undesired wrench movement yet readily permits wrench separation when grasped by their user's fingertips.

Notwithstanding the prior art, it remains desirable to provide an improved wrench rack having repetitive structure for securing a plurality of wrenches against accidental displacement and allowing an easy retrieval for the user.

SUMMARY OF THE INVENTION

It is a general object of the present invention to provide a tool rack which will reliably retain a set of wrenches within the rack in ascending/descending order.

It is also an object of the present invention to provide a tool rack which is capable of high volume production to effect a rack having a low cost of manufacture.

It is an additional object of the present invention to provide a tool rack which accommodates a multiplicity of wrenches without having to rotate the wrench handle in the rack.

In one aspect of the invention, a wrench rack for retaining wrenches includes a generally planar web having opposite side edges and a pair of arms having distal and a proximal ends and extending from the opposite edges and formed with pairs of aligned slots for receiving wrenches. Each of the slots is preceded by a rounded nose at a distal end of the arm and succeeded by a spine at a proximal end of the arm, the nose being formed generally perpendicular thereto with a laterally extending tab. Each of the slots has a curvilinear upper wall, a linear rear wall and a linear lower wall, and an open end opposite the rear wall. Each nose is integrally formed with an elongated, curved, resilient finger projecting into an upper portion of the slot and terminating short of the rear wall. When a wrench is inserted into the open end of each slot, a bottom surface of a wrench is guided by the tab and simultaneously, the finger is deflected towards the upper wall of the slot and continuously asserts a biasing force on a top surface of the wrench as the wrench is pushed into the slot. The slot is sized such that a leading edge of the wrench contacts the rear wall of the slot as a trailing edge of the wrench disengages from the tab, the finger holding the wrench in position against the lower wall of the slot. The tab is provided with indicia reflective of the size of the wrench inserted in the slot. The open end of the slot is defined by lower surface of the nose and the top edge of the tab. The lower wall has an end which terminates at the tab. The web has a top edge and a bottom edge, and the opposite edges diverge from the top edge to the bottom edge. The upper wall has a linear portion which extends generally parallel to a longitudinal center line passing through the slot, and a curved portion which extends upwardly and forwardly from the rear wall of the slot.

Various other objects, features, and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
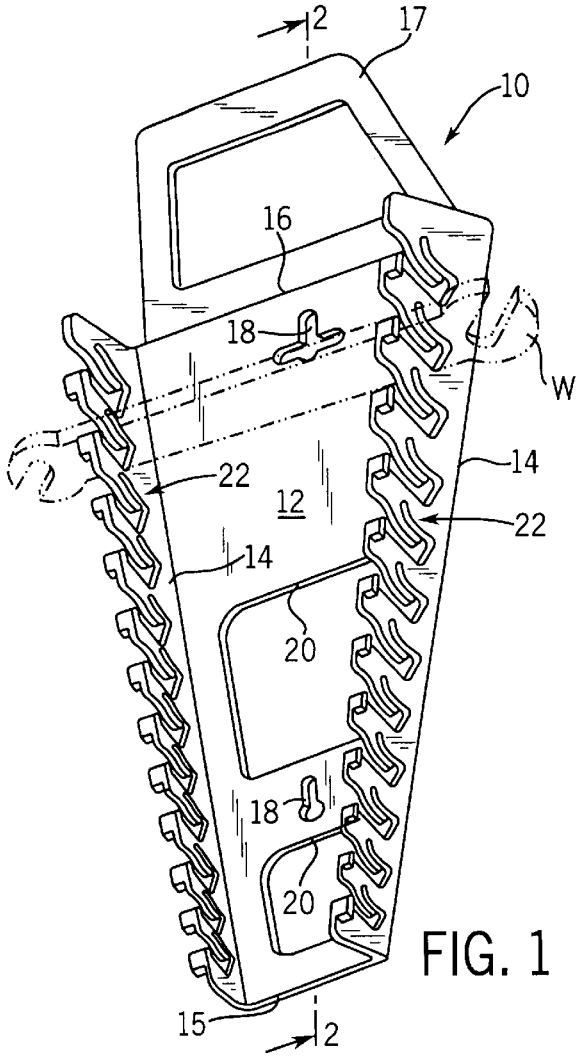
FIG. 1 is a perspective view of a wrench rack in accordance with the invention showing a wrench retained therein in phantom lines.

Referring now to the drawings, FIG. 1 illustrates a tool holder in the form of a wrench rack identifiable generally by the reference from row 10. The rack 10 includes a trapezoidal-shaped planar web 12 having a pair of opposite side edges 14 which diverge to a bottom edge 15 from a top edge 16 thereof provided with a hand grip 17 adapted to allow the rack 10 to be carried in a vertical orientation. The web 12 is also formed with a pair of spaced openings 18 for receiving appropriately sized wall mounted fasteners (not shown) so as to enable a removable mounting to a vertical wall. The web 12 may also be formed with a pair of large material relieving windows 20.

Figure 2:
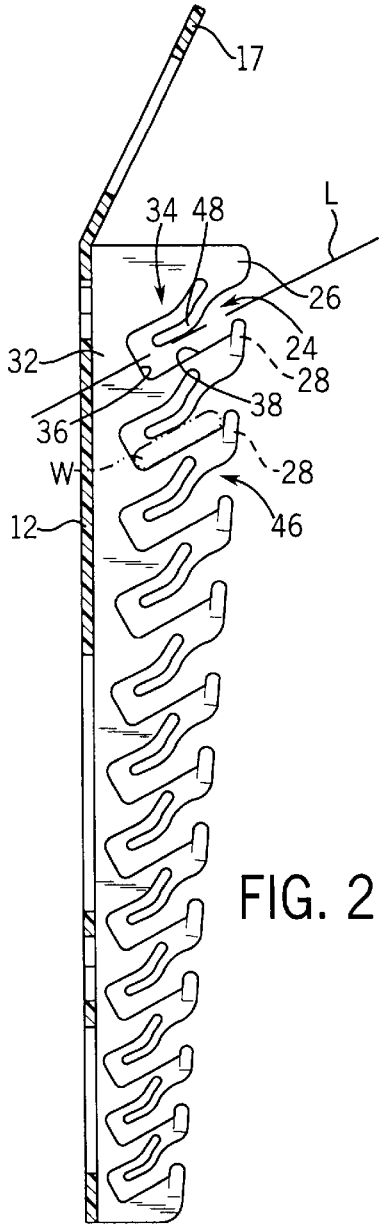
FIG. 2 is a sectional view taken on line 2—2 of FIG. 1.
Figure 4:
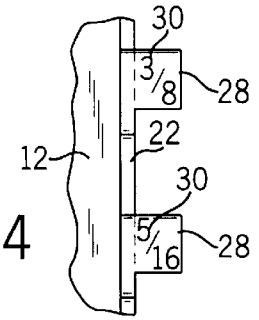
FIG. 4 is a partial elevational view taken on line 4—4 of FIG. 3.
Figure 3:
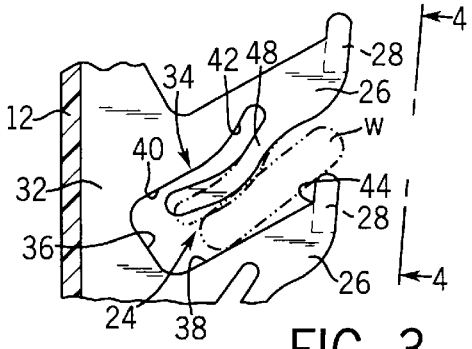
FIG. 3 is an enlarged, detailed view of a portion of a wrench rack shown in FIG. 2, showing in phantom lines, the manner in which a wrench is inserted in the rack.

Extending forwardly from the edges 14 is a pair of arms 22 for retaining a set of wrenches (one being shown at W)

which extend across the web 12 and are held within a series of aligned slots 24 on each arm 22. As seen in FIGS. 2 and 3, each slot 24 has a longitudinal center line L which is oriented at a generally acute angle with respect to web 12. Each slot 24 is preceded by a rounded nose 26 or each pair of corresponding noses 26, with the exception of the upper most pair, is formed generally perpendicularly thereto with a planar laterally and outwardly extending tab 28. Each tab 28 is provided with appropriate indicia 30 reflective of the wrench size (standard or metric) as best seen in FIG. 4. Each of the slots 24 is succeeded by a rigidifying spine 32 which runs continuously along each edge 14.

Each slot 24 has a curvilinear upper wall 34, a linear rear wall 36 and a linear lower wall 38. Upper wall 34 has a linear portion 40 which extends generally parallel to a longitudinal center line L and a curved portion 42 which projects upwardly and forwardly as seen in FIGS. 2 and 3. Lower wall 38 has a forward end 44 which terminates at the next succeeding tab 28. Each slot 24 is formed with an open end 46 defined by a lower surface of nose 26 and a top surface of tab 28. Formed integrally with each nose 26 is an elongated, curved, resilient retaining finger 48 which extends rearwardly and downwardly into the upper half of the slot 24. Each finger 48 projects towards and terminates short of rear wall 36. As will be understood below, the bottom of the finger 48 is slidingly engageable with a top surface of a wrench to be held in the slot 24.

Referring now to FIG. 3, when the leading edge of a wrench is inserted into open end 46 of a suitably sized slot 24, a bottom surface of the wrench W is guided along a top edge of tab 28. At the same time, the top surface of the wrench W forces the retaining finger 48 to deflect (as shown in phantom) into the upper half of the slot 24 towards the upper wall 34. The finger 48 asserts a biasing force on the leading end of the wrench W as the wrench is pushed further into the slot 24. Once a trailing end of the wrench W has cleared the tab 28, the leading end will contact the rear wall 36 of slot 24 and the retention finger 48 will reliably and positively hold the same in place as shown in phantom and FIG. 2. Thus, it can be seen that the tab provides a two-fold function of guiding a wrench into the slot 24 and providing a surface upon which a wrench parameter is displayed. When it is desired to remove the wrench W, one simply grasps the mid portion of the wrench W and pulls the wrench outwardly overcoming the biasing force of the finger 48.

It is noted that the wrench rack 10 may be constructed in any suitable material such as rubber or plastic which is durable and relatively light weight and has strength characteristics to support a plurality of wrenches W. It is also noted that while the wrench rack 10 is preferably disposed for vertical orientation, it is entirely possible to lay the web on a horizontal or angled surface.

It should now be appreciated that the present invention provides a wrench rack which securably stores and organizes, such as by size, a set of wrenches in a parallel, stacked formation. Unlike prior art designs, there is no need for a restraining bar or additional retaining element, expensive tooling for forming complex resilient members in the slot, or auxiliary resilient members on the web.

While the invention has been described with reference to a preferred embodiment, those skilled in the art will appreciate that certain substitutions, alternations and omissions may be made without departing from the spirit thereof. Accordingly, the foregoing description is meant to be exemplary only, and it should not be deemed limitative on the scope of the invention as set forth with the following claims.

I claim:

1. A wrench rack for frictionally retaining wrenches comprising:

a generally planar web having opposite side edges, a pair of arms having distal and proximal ends and extending from the opposite edges and formed with pairs of aligned slots for receiving wrenches, each of the slots being preceded by a curved nose at a distal end of the arm and succeeded by a spine at a proximal end of the arm, the nose being formed generally perpendicularly thereto with a planar, wrench size indicia bearing tab extending laterally outwardly from each of the arms, the tab having a rounded upper portion, each of the slots having a curvilinear upper wall, a linear rear wall and a continuously linear lower wall, and an open end opposite the rear wall, each nose being integrally formed with an elongated, curved, resilient finger projecting into an upper portion of the slot and terminating short of the rear wall, a lower surface of the finger being recessed to define an enlarged mouth at the open end for freely receiving a leading edge of a wrench to be frictionally retained in the rack, wherein the upper wall has a linear portion which extends generally parallel to a longitudinal centerline passing through the slot, and an inclined portion which extends continuously upwardly and forwardly at an acute angle relative to the rear wall of the slot, whereby, when a wrench is freely inserted into the enlarged open end of each slot, a bottom surface of a wrench is guided by the rounded upper portion of the tab and simultaneously the finger is deflected towards the upper wall of the slot and continuously asserts a single biasing force on a top surface of the wrench as a wrench is pushed into the slot, the slot being sized such that the leading edge of the wrench contacts the rear wall of the slot as a trailing edge of the wrench disengages from the rounded upper portion of the tab, the finger alone holding the wrench in position against the lower wall of the slot, the wrench being released by pulling the wrench outwardly through the enlarged mouth so as to overcome the biasing force of the finger.

2. The wrench rack of claim 1, wherein the open end of the slot is defined by a lower surface of the nose and a top edge of the tab.

3. The wrench rack of claim 1, wherein the lower wall has an end which terminates at the tab.

4. The wrench rack of claim 1, wherein the web has a top edge and bottom edge, and the opposite side edges diverge from the bottom edge to the top edge.

* * * * *